US005127115A

United States Patent [19]

Williams et al.

[11] Patent Number: 5,127,115

[45] Date of Patent: Jul. 7, 1992

[54] EXPANDABLE SKIRT MATTRESS COVER

[75] Inventors: Dale C. Williams, Dallas; Philip J. Souza, Plano; Rhonda R. Boyter, Euless, all of Tex.

[73] Assignee: Pillowtex Corporation, Dallas, Tex.

[21] Appl. No.: 759,393

[22] Filed: Sep. 13, 1991

[51] Int. Cl.[5] ..... A47G 9/04

[52] U.S. Cl. ..... 5/497; 5/482; 112/262.1; 297/224; 428/229; 428/230; 428/231; 428/253

[58] Field of Search ..... 5/497, 495, 496, 498, 5/482; 297/224; 428/229, 230, 231, 253; 112/262.1

[56] References Cited

U.S. PATENT DOCUMENTS 3,290,702 12/1966 Seltzer ..... 5/497
3,424,649 1/1969 Nyberg et al. ..... 428/516
3,789,441 2/1974 Weiss ..... 5/497
4,672,702 6/1987 Isham ..... 5/497
4,962,546 10/1990 Vitale ..... 5/497
4,980,941 1/1991 Johnson, III ..... 5/497
4,985,953 1/1991 Seago ..... 5/497

*Primary Examiner*—Alexander Grosz
*Attorney, Agent, or Firm*—Harold E. Meier

[57] ABSTRACT

The invention comprises an expandable skirt mattress cover and a method for making a mattress cover. The mattress cover includes a top platform attached to a skirt having an elastic band. The mattress cover is manufactured using the steps of stretching the skirt farbic; attaching the top platform to the skirt; stretching the elastic band and the skirt fabric; and attaching the elastic band to the skirt. Because the skirt stretches in two directions, the mattress cover adjusts to fit same-size mattresses of differing thicknesses.

13 Claims, 3 Drawing Sheets

EXPANDABLE SKIRT MATTRESS COVER

TECHNICAL FIELD

This invention relates to mattress covers, and in particular to a expandable skirt mattress cover and a method for manufacturing expandable skirt mattress covers.

BACKGROUND OF THE INVENTION

Mattress covers are well known in the art. One of the most common mattress covers utilizes sections of non-stretchable fabric which are stitched together to form a top platform and a skirt which descends from the platform. An elastic band stitched to the bottom edge of the skirt aids in conforming the mattress cove to the mattress. Although this type of mattress cover is relatively inexpensive, it has at least one disadvantage: the skirt cannot expand to mattresses with varying thicknesses.

In recent years, manufacturers have increased the thickness or depth of mattresses, while maintaining the same length and width. Thus, if a consumer replaces one queen-sized mattress with another, the new mattress may have considerably more depth than the previous mattress, even though it is also queen-sized. As a result, the consumer's previous mattress cover may not fit the new mattress.

In an effort to solve this problem, manufacturers have attempted to manufacture adjustable mattress covers. For example, one supplier of mattress covers combined fabrics with different amounts of stretchability to construct an adjustable mattress cover with stretch in the XD or cross direction, e.g. along the width of the fabric. Although this design appeared to solve the increased mattress depth problem, it was relatively expensive to produce.

U.S. Pat. No. 4,985,953 assigned to Louisville Bedding Co. described an attempt to solve the mattress depth problem using a two-step method. A basic skirt fabric was woven and elastic cords were then stitched into the woven fabric to create gathers in the skirt. A top platform and a bottom elastic band were then attached to the skirt. The resulting mattress cover was adjustable due to the stretch in the XD direction of the skirt fabric.

Although the prior art adjustable mattress covers apparently adjusted to mattresses of different thicknesses, such presently available covers have at least one undesirable side effect: unnecessary bulk. For example, when a mattress cover designed to adjust to mattresses with thicknesses ranging from 7" to 14" is placed on a 7" thick mattress, there is a large amount of extra fabric in the skirt which must be handled. The prior art mattress covers generally deal with the bulkiness problem by tucking the extra fabric underneath the mattress. This creates an uneven appearance on the mattress and makes the cover difficult to put in place.

In addition, the prior art adjustable mattress covers do not fit the upper surface and four corners of the mattress very well due to the manufacturing process. No tension is placed on the skirt fabric in the MD on longitudinal direction e.g. along the length of the skirt, prior to the skirt's attachment to the top platform. As a result, the mattress cover may not conform smoothly to the sides, corners and top of the mattress, and creates wrinkles in the mattress cover and in sheets place over the mattress cover.

Another problem associated with prior art adjustable mattress covers is attaching the elastic band to a skirt having greater elasticity. Usually, a skirt is stitched to an elastic band in its relaxed, unstretched position. When the finished mattress cover is subsequently placed on a mattress, the thread used to attach the elastic band and the skirt breaks due to the greater amount of stretch in the skirt relative to the thread. When the thread breaks, the elastic band disengages from the skirt, and ceases to conform the mattress cover to the mattress.

SUMMARY OF THE INVENTION

The present invention comprises an expandable skirt mattress cover and method for manufacturing expandable skirt mattress cover which overcomes the foregoing disadvantages associated with the prior art. A mattress cover includes a top platform which is secured to a skirt constructed of a fabric having stretch in two directions. An elastic band is attached to one edge of the skirt to function with the expandable skirt to conform the mattress cover to the mattress.

An expandable skirt mattress cover of the present invention is manufactured using the steps of stretching the skirt fabric; attaching the top platform to the skirt; stretching the elastic band and the skirt fabric; and attaching the elastic band to the skirt.

The resulting mattress cover adjusts to fit same-size mattresses having different thicknesses.

DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
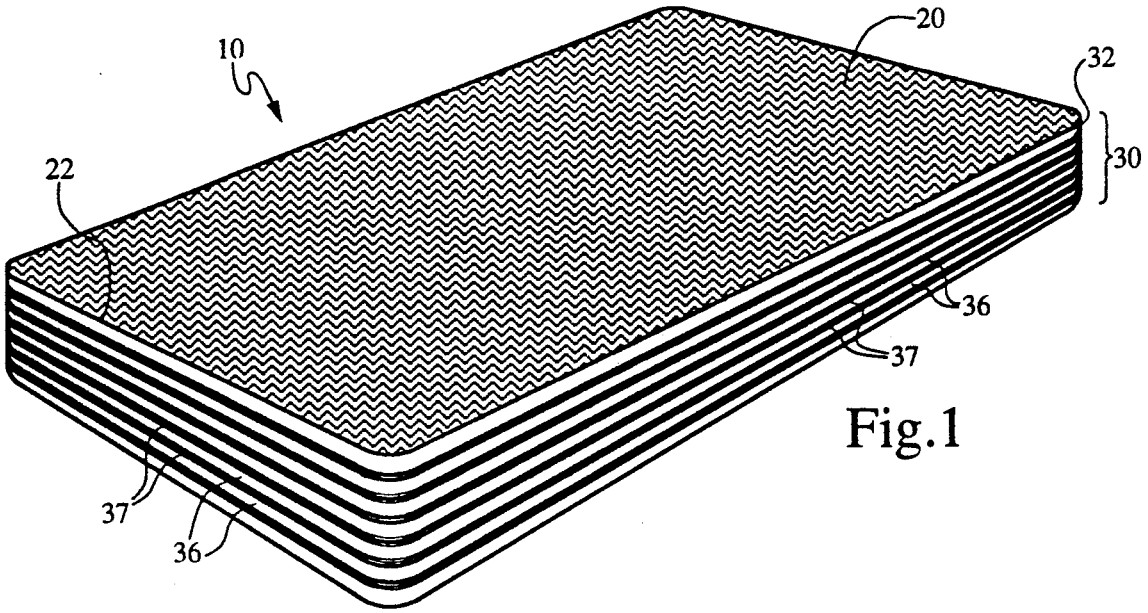
FIG. 1 is perspective top view of a mattress cover showing the features of the invention.

Referring now to the drawings wherein like reference characters designate like or similar parts throughout the several views, FIG. 1 is a perspective top view of a mattress cover showing the features of the invention. An expandable skirt mattress cover 10 includes a top platform 20 secured to a mattress skirt 30.

The top platform 20 is a flat, generally rectangular section of fabric having a peripheral edge 22. The platform 20 is constructed of fabric well known in the art. Dimensions of the platform vary according to the size of the mattress. The platform 20 overlies and substantially covers the top surface of a mattress. It is attached to a first edge 32 of the mattress skirt 30 via stitching or other appropriate means.

The mattress skirt 30 is constructed of a fabric having stretch in two directions. The fabric has stretch in the machine direction ("MD") and in the cross direction ("XD"). Machine direction refers to the length of fabric direction, i.e. the direction of the stitching. Cross direction refers to the direction across the machine direction, i.e. the width of fabric direction.

When a mattress cover utilizing skirt fabric having two-direction stretch according to the invention is placed on a mattress, the skirt 30 is positioned lengthwise around the side and end panels of the mattress. If the perimeter or circumference of the mattress is defined by the side and end panels, MD stretch occurs in the circumferential direction. Stretch in the MD direction of the skirt fabric ensures that the top platform 20 conforms to the top surface and the four corners of the mattress, independent of the mattress's thickness. Stretch in this direction solves the bagginess problem associated with prior art adjustable mattress covers.

Stretch in the skirt fabric in the XD direction occurs perpendicular to the circumference of the mattress. Stretch in the XD direction of the fabric ensures that a resulting mattress cover adjusts and conforms to the depth or thickness of the mattress, independent of the mattress's thickness. Stretch in this direction allows a consumer to use a single mattress cover incorporating the invention on mattresses ranging in thickness from 7" to 15".

Fabric having stretch in the MD direction ranging from substantially 50% to substantially 70% may be used to manufacture a mattress skirt 30 according to the invention. A preferred stretch in the MD direction is approximately 60%. Similarly, fabric having stretch in the XD direction ranging from 25% to 40% may be used to manufacture the skirt 30, with a preferred stretch in the XD direction of approximately 30%.

In the preferred embodiment, the skirt 30 is constructed of a woven fabric having stretch properties in the MD direction and the XD direction. The substrate fabric is a 100% polyester, non-woven fabric such as poly-sontara from DuPont. This substrate has no stretch itself. Stretch in the skirt 30 is achieved through the knit construction of polyester thread knitted into the substrate.

Two types of threads are alternately knitted into the substrate fabric. One is a synthetic marketed under the trademark Lycra where the thread is covered with texturized nylon. The nylon covered around the synthetic thread provides dimensional stability. Alternating with the nylon-wrapped synthetic thread is a polyester thread.

Figure 3A:
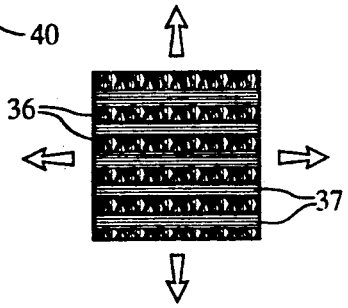
FIG. 3A is an enlarged view of a swatch of the fabric from the mattress skirt in its relaxed or unstretched position.

Referring to FIG. 3A, in the preferred embodiment the Lycra synthetic threads are knitted into the substrate fabric at approximately 1" intervals. Nylon-wrapped Lycra synthetic threads are knitted into the substrate fabric only in the MD direction using a simple chain stitch. The polyester threads are knitted into the substrate fabric only in the XD direction using a tricot stitch.

The resulting skirt fabric has a striped or banded appearance due to the presence of the two types of thread. The polyester threads create a band 36 in the fabric having a rippled appearance. The nylon-wrapped Lycra synthetic threads create a band 37 in the skirt fabric exhibiting a smooth, flat appearance.

The fabric does not respond identically to maximum stretch in the two directions. Specifically, there is a greater recovery in the MD direction than in the XD direction following extension. There is also a change in the % stretch during the finishing process for the skirt fabric. Initially, the fabric has 120% stretch in the MD direction. During the finishing process, the nylon-covered synthetic threads are heat-set on a tenter frame. This process reduces the MD stretch in the finished skirt fabric to approximately 60%. There is no corresponding change in the stretch in the XD direction during the finishing process because no synthetic threads are woven into the fabric in the XD direction. In the preferred embodiment, the skirt fabric has a weight of 70 denier.

Figure 2A:
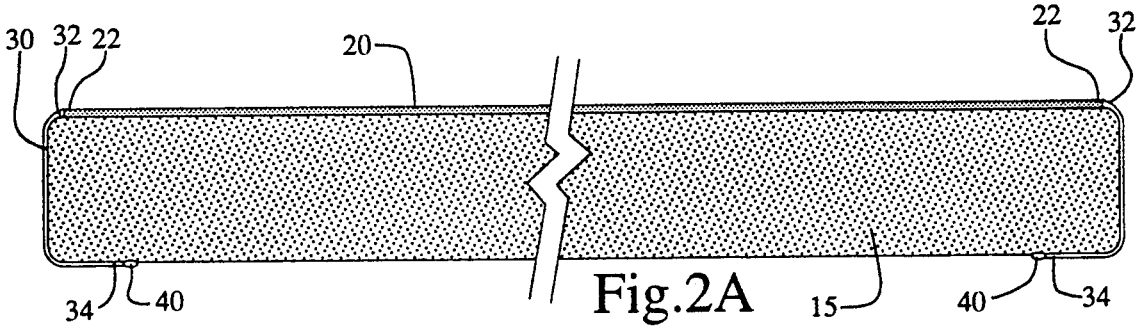
FIG. 2A is a cross-sectional side view of a mattress cover in accordance with the present invention installed on a mattress.
Figure 2B:
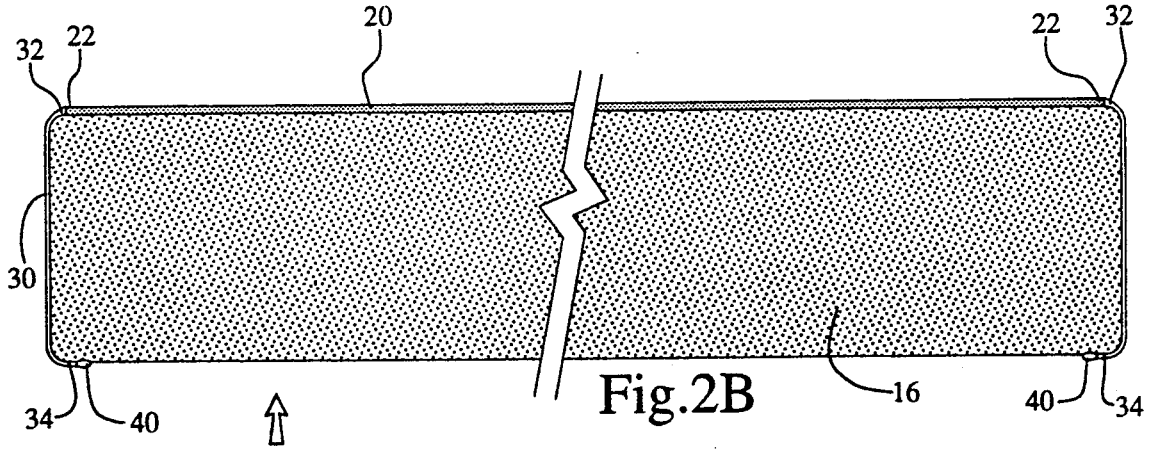
FIG. 2B is a cross-sectional side view of a mattress cover in accordance with the present invention installed on a same-size mattress with a different thickness.

Referring now to FIGS. 2A and 2B, there are shown side cross-sectional views of a mattress cover 10 according to the invention installed on two mattresses 15 and 16 of differing thicknesses. In both FIGS. 2A and 2B, the top platform 20 overlies and substantially covers the top surface of the mattresses 15 and 16.

Secured to the top platform 20 is a skirt 30 having stretchability in the XD and MD directions. The peripheral edge 22 of the platform 20 is stitched to the first end 32 of the skirt 30. Stretch in the XD direction of the skirt 30 permits the mattress cover to adjust to the thickness of both mattresses 15 and 16. Specifically, the mattress cover expands to completely cover the thicker mattress 16.

Tension in the MD direction causes the skirt fabric to be pulled beneath the mattresses 15 and 16, producing a smooth, finished appearance. Due to the stretch in the MD direction, the mattress cover fits snugly against each mattress's upper surface and at its four corners, independent of the mattress's thickness.

Attached via stitching to the second end 34 of the skirt 30 is an elastic band 40. The elastic band may be sewn by hand or attached with other appropriate means. Cut rubber or a material with similar properties may be used. The elastic band 40 is attached to the skirt 30 such that when the mattress cover 10 is placed on the mattress, the elastic band 40 is positioned on the underside of the mattress. The elastic band 40 aids in conforming the mattress cover 10 to the mattress. Because the mattress 15 in FIG. 2B is not as thick as the mattress 16 in FIG. 2A, the elastic band 40 will be positioned farther underneath the mattress 15.

Figure 3B:
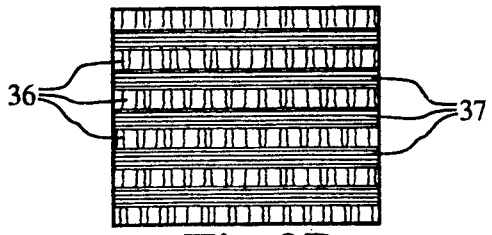
FIG. 3B is an enlarged view of a swatch of the fabric from the mattress skirt in its expanded or stretched position.

Referring now to FIGS. 3A and 3B, there are shown enlarged views of the fabric used to construct the mattress skirt 30. FIG. 3A illustrates the fabric in its relaxed, unstretched position, while FIG. 3B illustrates the fabric in an extended, stretched position. In both FIGS. 3A and 3B, there is shown the striped or banded appearance of the skirt fabric. Nylon-wrapped Lycra synthetic threads are woven into the polyester substrate in the MD direction. Polyester threads are woven into the polyester substrate in the XD direction.

In FIG. 3A, the polyester threads produce a band 36 in the fabric having a rippled appearance. In contrast, the nylon-wrapped Lycra synthetic threads produce a band 37 having a smooth, flat appearance.

In FIG. 3B, the fabric is fully extended in the XD and MD directions. The fabric has stretched 60% in the MD direction and 30% in the XD direction. The fabric still has a striped or banded appearance, however, the rippled appearance of the band 36 created by the polyester threads is substantially reduced.

Figure 4:
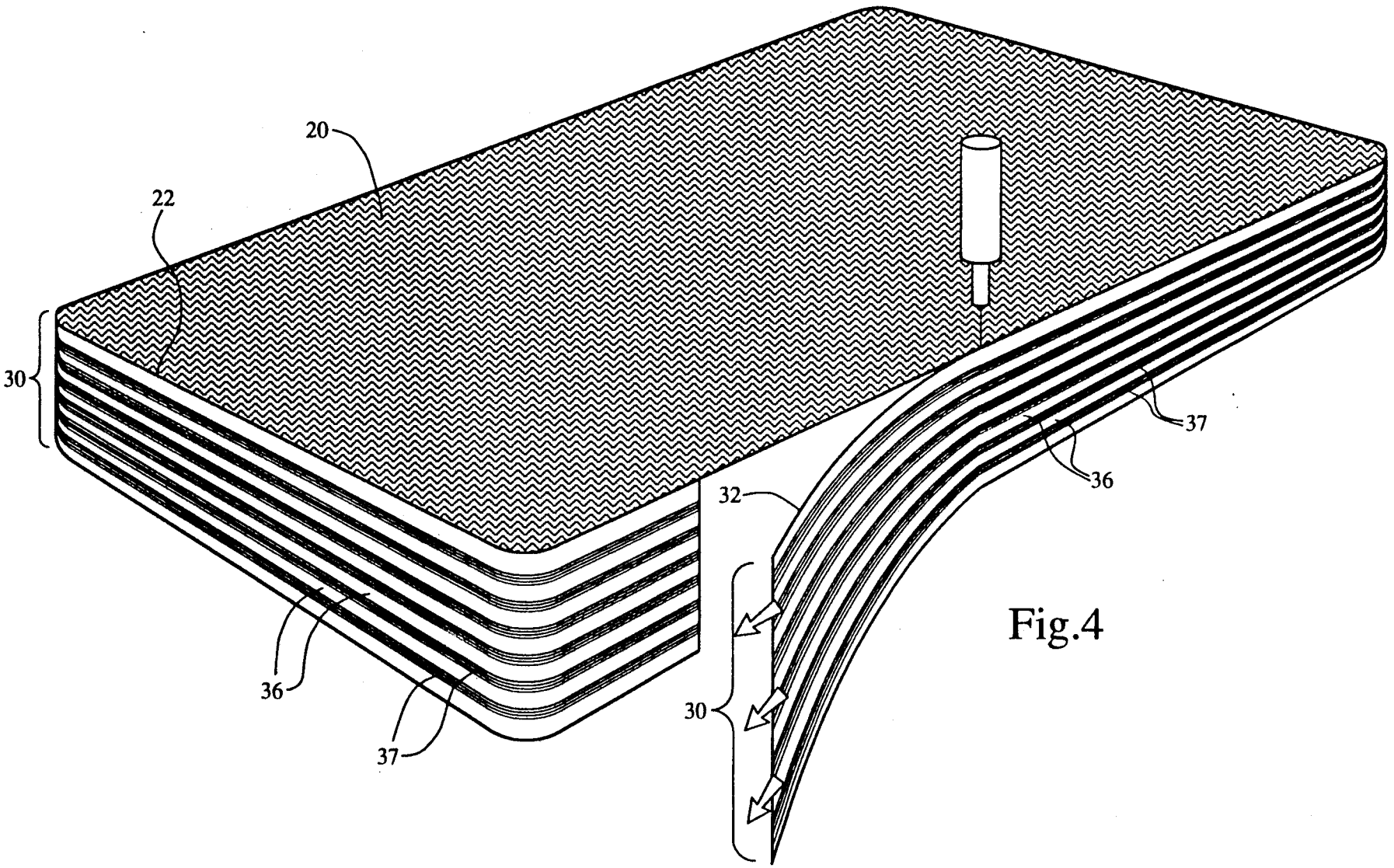
FIG. 4 is an illustration of the method of sewing the mattress skirt to the top platform for the mattress cover illustrated in FIG. 1.
Figure 5:
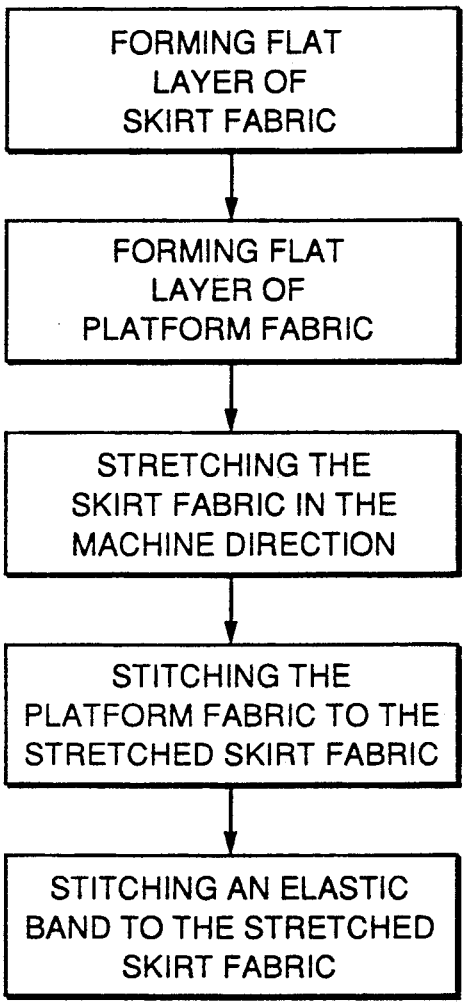
FIG. 5 is a flow diagram illustrating the manufacturing process to assemble the mattress cover of the present invention.

Turning now to FIGS. 4 and 5, there is illustrated the steps of a process for manufacturing the mattress cover illustrated in FIGURE The process results in the assembly of the mattress skirt 30, the top platform 20 and the elastic band 40.

Initially, the flat skirt fabric is formed in a skirt step followed by a platform step where the flat platform fabric is formed. Of course, these two steps may be reversed. Next, in a stretch step, the skirt fabric is stretched.

Tension is placed on the skirt 30 in the MD direction. The fabric may be stretched by hand or via machine, however, tension should be uniform along the length of the skirt 30. The peripheral edge 22 of the platform 20 aligns with the first end 32 of the skirt 30. Substantially simultaneously, in a stitching step, the top platform 20 is stitched to the stretched skirt 30.

Next, the elastic band 40 is stretched to its fully expanded position. Tension is again exerted on the skirt 30 in the MD direction. In the preferred method, the elastic band 40 and the skirt 30 are stretched substantially an equal amount. The elastic band 40 is stretched to the second end 34 of the skirt 30. The elastic band 40 may be sewn to the skirt 30 by hand or attached via other appropriate means.

When the resulting mattress cover is placed on a mattress, it will lie smoothly, maintain its position and conform to the mattress.

Although a preferred embodiment of the invention has been illustrated in the accompanying Drawings and described in the foregoing Detailed Description, it will be understood that the invention is not limited to the embodiment disclosed, but is capable of numerous rearrangements, modifications, and substitutions of parts and elements without departing from the spirit of the invention.

I claim:

1. A two dimensional expandable skirt mattress cover comprising:

a top platform for conformably overlying the top surface of a mattress; and a skirt attached along one edge to and descending from the periphery of the top platform for conformably adhering to the sides and ends of the mattress, the skirt comprising:

a stretchable woven fabric having stretch in a machine direction along the length of the fabric and stretch in a cross direction along the width of the fabric, said fabric comprising a substrate of a non-woven fabric with at least two types of threads knitted into the substrate; and elastic means attached to a second edge of the periphery of the stretchable fabric.

2. The mattress cover according to claim 1 wherein the said fabric has a stretch of substantially 60% in the machine direction and a stretch of substantially 30% in the cross direction.

3. The mattress cover according to claim 1 wherein said non-woven substrate comprises a 100% polyester fabric.

4. The mattress cover according to claim 3 wherein said substrate comprises a poly-sontara fabric.

5. The mattress cover according to claim 1 wherein the non-woven substrate is knitted with synthetic threads and polyester threads.

6. The mattress cover according to claim 5 wherein the synthetic threads are covered in texturized nylon.

7. The mattress cover according to claim 5 wherein the synthetic threads and polyester threads are alternately woven into said fabric.

8. The mattress cover according to claim 7 wherein the synthetic threads are knitted in the MD direction and the polyester threads are knitted in the XD direction.

9. The mattress cover according to claim 7 wherein the synthetic threads are knitted into said substrate using a chain stitch and the polyester threads are knitted into said substrate using a tricot stitch.

10. The mattress cover according to claim 1 wherein said fabric has a weight of substantially 70 denier.

11. A method for manufacturing a two dimensional expandable mattress cover comprising the steps of:

stretching in a machine direction a mattress cover skirt constructed of a fabric having stretch in a machine direction along the length of the fabric and stretch in a cross direction along the width of the fabric, said fabric comprising a substrate of a non-woven fabric with at least two types of threads knitted into the substrate;

stitching a platform fabric to a first edge of the stretched skirt;

stretching an elastic band; and stitching the elastic band to a second edge of the stretched skirt.

12. The method for manufacturing a mattress cover according to claim 11 wherein the step of stretching the skirt comprises stretching in the machine direction along the length of the fabric.

13. The method for manufacturing a mattress cover according to claim 11 wherein the skirt and the elastic band are stretched substantially equal amounts.

* * * * *